US009085977B2

(12) United States Patent
Bonomi et al.

(10) Patent No.: US 9,085,977 B2
(45) Date of Patent: Jul. 21, 2015

(54) RIB FOR SUPPORTING AND REINFORCING AN EXCAVATION

(75) Inventors: Cristiano Bonomi, Peschiera Borromeo (IT); Antonio Frullani, Forte dei Marmi (IT)

(73) Assignee: ELAS GEOTECNICA S.R.L., Segrate (Milano) (IT)

( * ) Notice: Subject to any disclaimer, the term of this patent is extended or adjusted under 35 U.S.C. 154(b) by 0 days.

(21) Appl. No.: 13/575,534

(22) PCT Filed: Jan. 31, 2011

(86) PCT No.: PCT/EP2011/051324

§ 371 (c)(1), (2), (4) Date: Jul. 26, 2012

(87) PCT Pub. No.: WO2011/092331

PCT Pub. Date: Aug. 4, 2011

(65) Prior Publication Data

US 2012/0301223 A1 Nov. 29, 2012

(30) Foreign Application Priority Data

Jan. 29, 2010 (EP) ..... 10425019

(51) Int. Cl.

| | |
|---|---|
| ***E21D 11/18*** | (2006.01) |
| ***E21D 11/30*** | (2006.01) |
| ***E21D 11/24*** | (2006.01) |
| ***E21D 11/28*** | (2006.01) |

(52) U.S. Cl.

CPC ..... *E21D 11/28* (2013.01); *E21D 11/18* (2013.01); *E21D 11/24* (2013.01); *E21D 11/30* (2013.01)

(58) Field of Classification Search

CPC ..... E21D 11/18; E21D 11/24; E21D 11/28; E21D 11/30

USPC ..... 405/132, 288; 299/11

See application file for complete search history.

(56) References Cited

U.S. PATENT DOCUMENTS 2,333,826 A 11/1943 Smith et al.
2,793,719 A * 5/1957 Langerbein ..... 405/288

(Continued)

FOREIGN PATENT DOCUMENTS

DE 584 459 9/1933
DE 957 744 2/1957

(Continued)

OTHER PUBLICATIONS

Examination Report of European Patent Office issued in Application No. 10425019.6 dated May 14, 2012 (4 pages).

(Continued)

*Primary Examiner* — Frederick L Lagman

(74) *Attorney, Agent, or Firm* — Flynn, Thiel, Boutell & Tanis, P.C.

(57) ABSTRACT

The present invention relates to a rib (1) for supporting and reinforcing an excavation. The invention also relates to a structure and to a method for supporting and reinforcing an excavation. The rib (1) according to the invention comprises at least a structural element (5A) provided with a tubular body (6), preferably with a circular cross section, which defines an inner cavity (9A) adapted to be completely filled with concrete after installation of the rib. The structural element is provided with a filling device (7) operatively couplable to concrete injection means.

14 Claims, 9 Drawing Sheets

(56) References Cited

U.S. PATENT DOCUMENTS

| | | | | |
|---|---|---|---|---|
| 3,022,100 | A * | 2/1962 | Heintzmann | 405/288 |
| 3,023,862 | A * | 3/1962 | Launay | 405/288 |
| 3,126,708 | A * | 3/1964 | Jasper | 405/288 |
| 4,095,433 | A | 6/1978 | Yamamoto et al. | |
| 4,185,940 | A * | 1/1980 | Spies | 405/288 |
| 4,465,405 | A * | 8/1984 | Durrfeld | 405/288 |
| 5,833,394 | A * | 11/1998 | McCavour | 405/288 |
| 6,595,722 | B2 | 7/2003 | McCavour | |
| 2006/0174549 | A1* | 8/2006 | Dagher et al. | 52/86 |
| 2010/0266349 | A1* | 10/2010 | Ma et al. | 405/288 |
| 2012/0282041 | A1* | 11/2012 | Breedlove et al. | 405/288 |

FOREIGN PATENT DOCUMENTS

| | | |
|---|---|---|
| DE | 26 27 256 | 12/1977 |
| FR | 1 101 491 | 10/1955 |
| FR | 1 242 686 | 9/1960 |
| GB | 856 076 | 12/1960 |
| GB | 2 069 027 A | 8/1981 |
| JP | 2003-041708 | 2/2003 |

OTHER PUBLICATIONS

Form PCT/IPEA/416 mailed Jul. 23, 2012 (1 page).
Form PCT/IPEA/409 mailed Jul. 23, 2012 (5 pages).
Response dated Feb. 14, 2012 responding to Written Opinion issued in PCT/EP2011/051324 (5 pages).
Response dated Jul. 3, 2012 responding to Written Opinion issued in PCT/EP2011/051324 (2 pages).
Form PCT/ISA/220 mailed Aug. 3, 2011 (1 page).
Form PCT/ISA/210 mailed Aug. 3, 2011 (5 pages).
Form PCT/ISA/237 mailed Aug. 3, 2011 and reply thereto dated Feb. 14, 2012 (6 pages).
Form PCT/IPEA/408 mailed Jun. 6, 2012 (5 pages).
Examination Report of European Patent Office issued in European Application No. 10 425 019.6 dated Jan. 24, 2014 (4 pages).

* cited by examiner

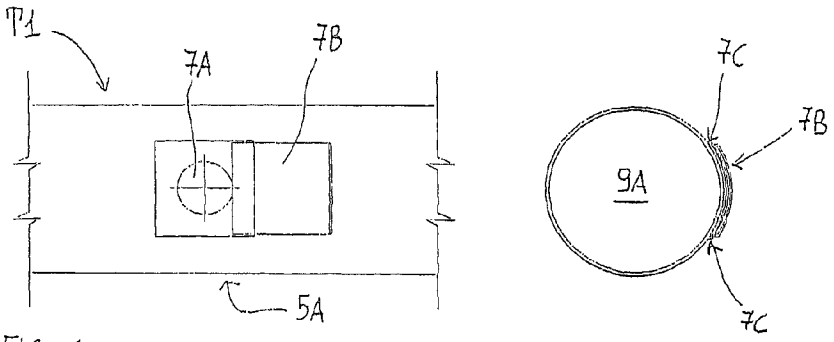
FIG. 6A
FIG. 6
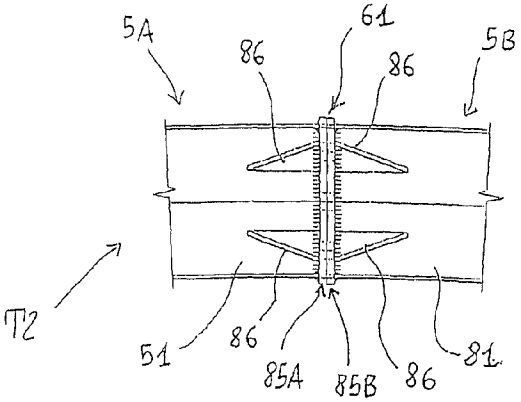
FIG. 4
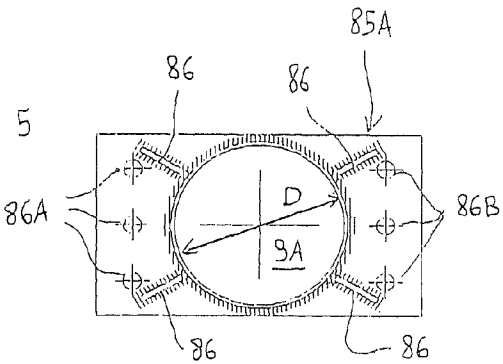
FIG. 5
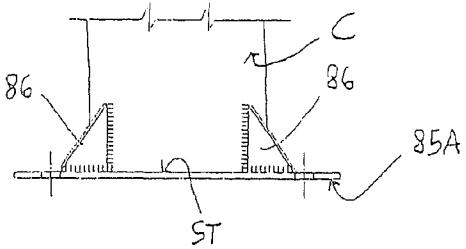
FIG. 5A

RIB FOR SUPPORTING AND REINFORCING AN EXCAVATION

FIELD OF THE INVENTION

The present invention falls within the scope of the production of elements for supporting an excavation, such as a railway, motorway or other type of tunnel. More precisely, the present invention relates to a rib for supporting and reinforcing an excavation. The invention also relates to a structure and to a method for supporting and reinforcing an excavation based on the use of one or more ribs according to the present invention.

STATE OF THE ART

As it is known, to support excavations, such as motorway or railway tunnels, reinforcing arches called "ribs" are used. In particular, a rib usually comprises a plurality of shaped steel elements mutually connected in a "vault" configuration. These elements are formed by "open" profiles with H, INP or double T cross section (in the case of multiple or double profiles) and are made integral with one another by a connecting element, namely tie plate. In the majority of cases, the profiles are mutually connected at the excavation to be reinforced, after having been shaped by metalworking. After being assembled, each rib is connected to those adjacent through connection links, the ends of which are coupled to supports welded along the body of the profiles of the ribs. The space between two consecutive ribs and the excavation wall is usually reinforced with sprayed concrete (shotcrete).

The use of profiles with open cross section (H, C or double T) has shown various drawbacks, the first of which concerns the mechanical strength offered. In fact, these profiles have a direction along which the static properties are penalized. In fact, the cross sections of open profiles do not have axial symmetry and therefore are not very suitable to work in conditions of load that give rise to stresses other than simple bending stress. In particular, these profiles have poor resistance to torsional stresses. These stresses could be generated, for example, due to poor conditions of contact of the profile with the excavation wall (wing of the section bar-ground) or due to operations to advance the excavation. In general, unpredictable behavior of the ground is poorly tolerated by ribs with H-profiles and even worse by those with double T profiles. To overcome this problem it is customary to increase the dimensions of the profiles (in terms of resistant cross section) when particularly difficult operating conditions are forecast. However, this choice leads to high costs and significant assembly difficulties due to the high weight of the profiles used.

Another drawback linked to open profiles, above all those that are coupled, is encountered in the reinforcing step using shotcrete. In fact, the shapes of the profiles (above all H cross sections) prevent the concrete from completely covering the surfaces of the rib (external and internal). In other words, empty pockets form around some parts of the cross section of the profile or profiles, clearly limiting the effectiveness of reinforcement. Added to this is the fact that the open shape of the cross sections makes welding of the supports to which the connection links are coupled particularly complicated. This obviously increases the manufacturing times and costs of the ribs. It is also observed that from the viewpoint of installation of the rib, the operations to connect the profiles are also relatively difficult again due to the configuration of the cross section of the profiles.

Within this aim, an object of the present invention is to provide a rib with high properties of resistance, which can therefore also be used in particularly difficult ground conditions.

Another object of the present invention is to provide a rib that can be easily installed in proximity to the excavation and the elements of which can be easily connected with limited times and costs.

A further object of the present invention is to provide a rib for supporting and reinforcing which is reliable and easy to manufacture at competitive costs.

Another aim of the present invention is to provide a structure and a method for supporting and reinforcing an excavation through one or more ribs according to the present invention.

SUMMARY OF THE INVENTION

The present invention relates to a rib for supporting and reinforcing an excavation comprising at least one structural element and characterized in that said element is provided with a tubular body, preferably with a circular cross section, provided with an inner cavity adapted to be completely filled with concrete after installation of the rib. The structural element is provided with a filling device operatively couplable to concrete injection means.

The rib preferably comprises a bearing element connected to a second end portion of the first structural element. The bearing element is preferably coupled to the first structural element so as to allow a relative movement thereof after pressurized injection of concrete inside the inner cavity.

According to a preferred embodiment, the rib according to the invention comprises a second structural element provided with a tubular body, preferably with a circular cross section, which defines an inner cavity adapted to be filled with concrete after installation of the rib. The inner cavities of the structural elements are preferably in mutual communication so as to use the filling device of the first element to introduce concrete into the cavity of both the elements.

The present invention is also relative to a structure for supporting and reinforcing an excavation comprising one or more ribs according to the present invention. The present invention is also relative to a method for supporting and reinforcing an excavation, characterized in that it comprises the steps of installing a first rib, according to the present invention, and of filling the inner cavities of the structural elements of said first rib with concrete, at least until complete filling thereof. The method preferably comprises the step of installing a second rib, according to the present invention, connecting said first rib to said second rib, through at least a connection link, and filling the cavities of the structural elements of the second rib with concrete at least until complete filling of these cavities.

The method according to the invention preferably includes connecting the first rib to the second rib through a plurality of connection links. Each connection link being coupled at opposite ends to a pair of connection members provided each at a same height on one of the two ribs.

LIST OF FIGURES

Further features and advantages of the present invention shall be apparent from the description of embodiments, shown by way of non-limiting example in the accompanying drawings, wherein:

FIG. 4 is a view relative to joining means of two structural elements of the rib of FIG. 1;

FIGS. 5 and 5A are views relative to a first end portion of a structural element of the rib of FIG. 1;

FIGS. 6 and 6A are orthogonal views of a length of a structural element of the rib of FIG. 1;

DETAILED DESCRIPTION

Figure 1:
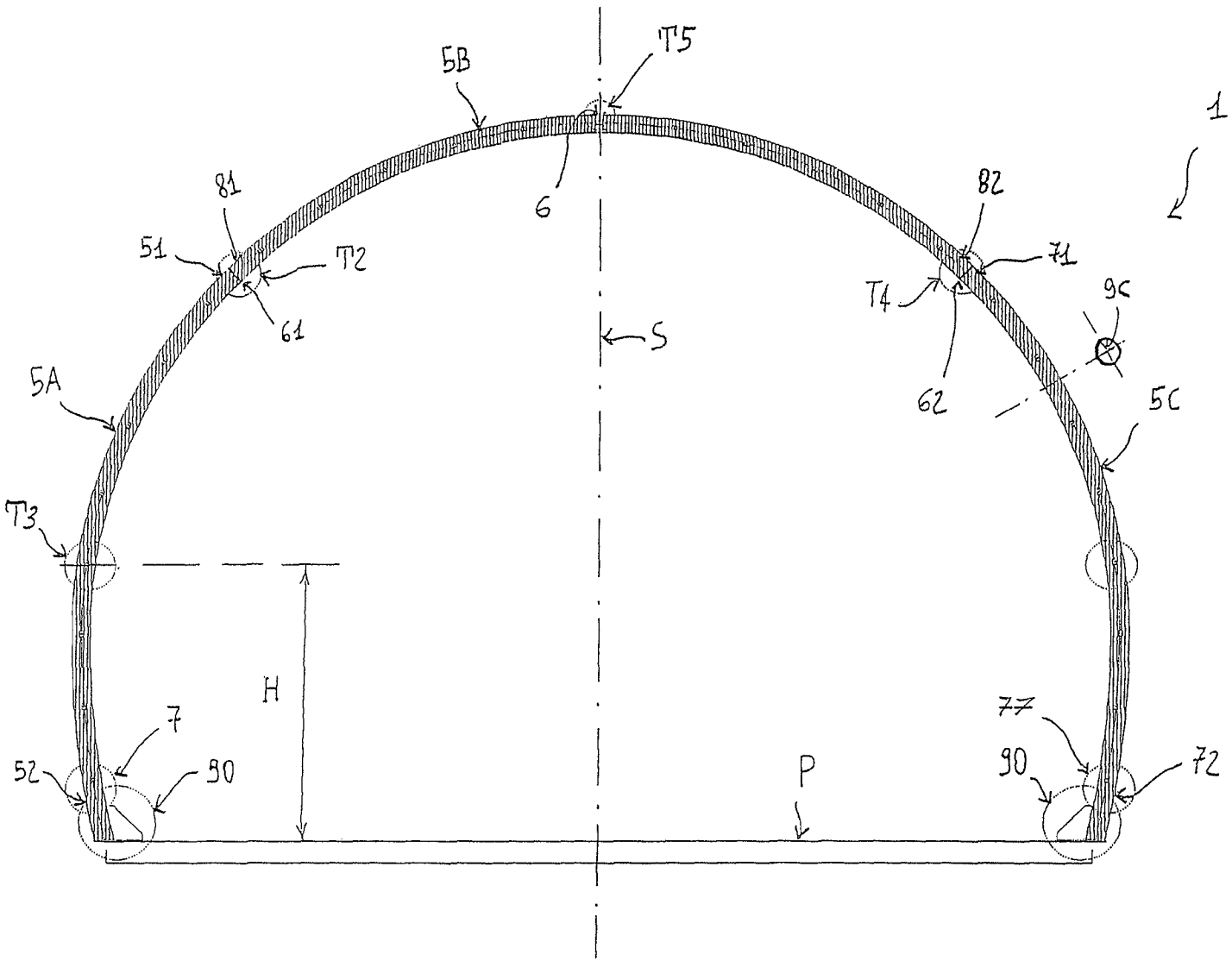
FIG. 1 is a front view of a first embodiment of a reinforcing rib according to the present invention.

FIG. 1 shows a possible embodiment of a rib for supporting and reinforcing (hereinafter indicated simply with the term "rib") according to the present invention which will be indicated throughout the description with the reference 1. The rib 1 is formed of one or more structural elements 5A,5B,5C preferably made of metal material, such as structural steel (Fe 430 or the like). The rib 1 has a symmetrical configuration with respect to a plane of symmetry S. In general, this configuration resembles the configuration of the portion of excavation to be reinforced by the rib.

The rib 1 in FIG. 1 comprises a first structural element 5A, a second structural element 5B connected to the first 5A and a third structural element 5C connected to the second structural element 5B. As shown, the first 5A and the third structural element 5C substantially have a mirror image position with respect to the plane of symmetry S of the rib 1. The second element 5B preferably extends symmetrically between the first 5A and the third element 5C with respect to the same plane of symmetry S. Alternatively, the rib according to the invention could be formed by a single structural element or even by a number of structural elements greater than three.

The first structural element 5A is formed by a tubular body provided with a first end portion 51 operatively connected to a first terminal portion 81 of the second element 5B and a second end portion 52 destined to be connected to a bearing element 90 of the rib 1. The tubular body of the first element 5A has a cross section, preferably circular, that defines an inner cavity 9A extending for the entire length of the body. This inner cavity 9A is destined to be completely filled with concrete after installation of the rib 1. The cross section of the tubular body can also assume other closed shapes, besides circular, such as square or rectangular.

The body of the first tubular element 5A also comprises a filling device 7 operatively couplable to means for injecting concrete into the inner cavity 9A of this body. In other words, the filling device 7 has the function of allowing the concrete to flow into the cavity 9A and simultaneously prevent the concrete from flowing out after completion of this filling. The concrete can be introduced using an injection pump or other functionally equivalent means.

The third structural element 5C has a structure substantially equivalent to that of the first element 5A. In particular, the third element 5C also comprises a tubular body preferably with a circular section that defines a relative inner cavity 9C destined to be completely filled with concrete after installation of the rib 1. Preferably, the third element 5C also comprises a filling device 77 associated with the tubular body of the element. A first end portion 71 of the third element 5C is destined to be connected to a second terminal portion 82 of the second structural element 5B. A second end portion 72 of the third structural element 5C in instead destined to be connected to a further bearing element 90 of the rib 1.

The second element 5B also has a tubular body with a cross section preferably, but not necessarily, equivalent in terms of shape and dimensions, to that of the first element 5A. Therefore, also the second element 5B preferably has a substantially circular cross section defining an inner cavity 9B (see FIG. 2) extending for the entire length of the element. A first terminal portion 81 of the second element 5B is connected to the first end portion 51 of the first structural element 5A through first joining means 61, while a second terminal portion 82 is connected to the first end 71 of the second structural element 5B through second joining means 62. In particular, the first 61 and the second joining means 62 are configured so that the inner cavity 9B of the second element 5B is in communication with those of the first 5A and of the third structural element 5C. Through this solution the concrete injected into the inner cavity of the first 5A and of the third structural element 5C (through the relative filling devices 7,77) can advantageously also reach the inner cavity 9B of the second element 5B to allow filling thereof.

According to the indications above, the structural elements 5A, 5B and 5C of the rib 1 are advantageously filled with concrete after installation of the rib inside the portion of excavation to be supported and reinforced, i.e. after mutual connection of the structural elements 5A,5B,5C. In other words, the structural elements 5A, 5B and 5C are connected to one another in situ (i.e. in the excavation) and subsequently filled with concrete.

Figure 2:
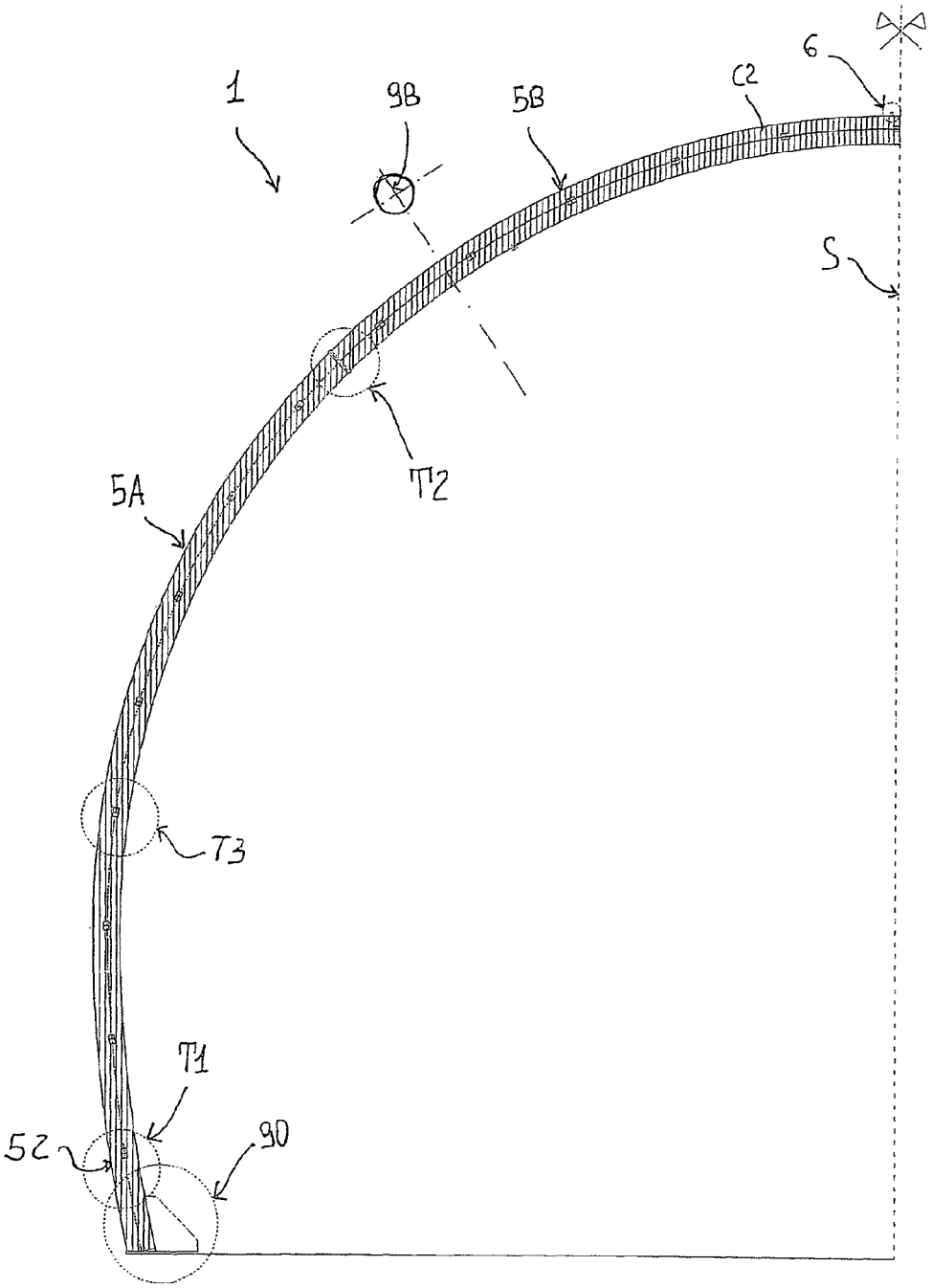
FIG. 2 is a view of a portion of the reinforcing rib of FIG. 1.
Figure 3B:
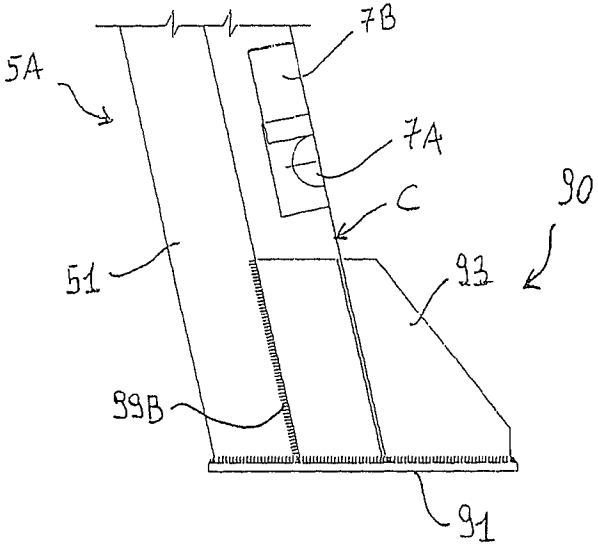
FIGS. 3, 3A and 3B are views relative to a first embodiment of a bearing element of a rib according to the present invention.
Figure 3A:
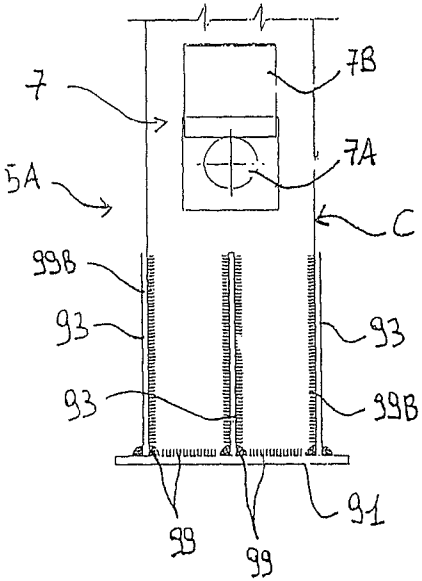
Figure 3:
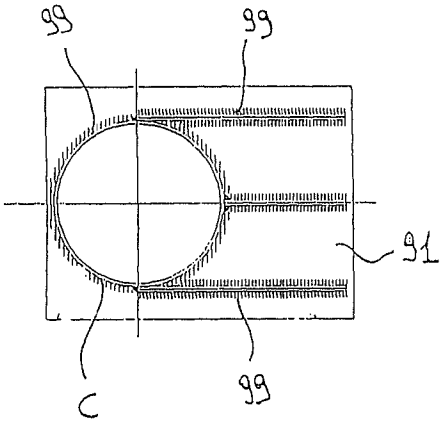

FIG. 2 shows the portion of the rib of FIG. 1 on the left with respect to the plane of symmetry S. The considerations below are also valid for the right portion of the rib 1 as a result of the symmetry that distinguishes it. As indicated above, the second end portion 52 of the first structural element 5A is connected to a bearing element 90, a first embodiment of which is shown in FIGS. 3 to 3B. In particular, according to this embodiment, the bearing element 90 comprises a base plate 91 which is welded to the terminal section of the tubular body C of the first structural element 5A. A plurality of stiffening plates 93 are welded to the base plate 91 and the outer surface of the tubular body C. The plan view of FIG. 3 shows the arrangement of the welds 99 which fasten the base plate 91 permanently to the tubular body and the stiffening plates 93 to this base plate. FIGS. 3A and 3B also show the arrangement of the welds 99B that permanently fasten the stiffening plates 93 to the tubular body of the first element 5A.

FIGS. 3 and 3A also show a possible embodiment of the filling device 7 indicated above, better visible in FIGS. 6 and 6A which are views of the length of tubular body C indicated with the reference T1 in FIG. 2. The filling device 7 comprises an opening 7A defined on the body C of the structural element 5A and a closing element 7B of said opening 7A movable between a closed position and an open position. In the specific case illustrated, the closing element 7B is formed of a plate sliding along the outer surface of the tubular body C through appropriate lateral guides 7C welded to the body. During filling of the inner cavities 9A, 9B, 9C of the structural elements 5A,5B,5C, the closing element 7B maintains an open position to allow insertion of appropriate injection means into the opening 7A. After completion of filling of the cavity, the injection means are removed and the closing element 7B is taken to the closed position to prevent outflow of the unset concrete.

FIG. 4 shows a detailed view of the length of rib 1 indicated in FIGS. 1 and 2 with the reference T2. This length is relative to the connection between the first 5A and the second structural element 5B. In particular, FIG. 4 shows in detail a possible embodiment of the joining means 61 that connect the first end portion 51 of the first structural element 5A to the first terminal portion 81 of the second structural element 5B. These first joining means 61 comprise a pair of joining plates 85A,85B destined to be mutually connected through bolts or other functionally equivalent means. FIGS. 5 and 5A specifically show a possible configuration of the plates 85A,85B.

A first joining plate 85A is welded to the tubular body C of the first structural element 5A at a relative terminal section ST. More precisely, the joining plate 85A is welded to the tubular body C through gusset plates 86 welded on one side to the plate and on the other side to the outer surface of the tubular body C. In the specific case shown, the joining plate 85A has a substantially rectangular configuration and comprises two series of opposite holes 86A,86B for connection of closing bolts (not shown in the figures). The plate 85A also comprises a circular opening with a diameter D corresponding to that of the terminal section ST of the tubular body C. The plate 85A is welded to the tubular body C so that this circular opening is concentric with the terminal section of the circular body.

The second joining plate 85B has a structure equivalent to that of the first joining plate 85A and is connected to the terminal section of the second structural element 5B in exactly the same manner as described above for the first plate 85A with reference to the connection with the first element 5A. The two plates 85A,85B are connected so that the relative circular openings are coaxial and communicating with the two inner cavities 9A,9B of the two structural elements 5A,5B.

With reference again to FIG. 1, the length of rib 1 indicated with the reference T4 is relative to the connection between the second structural element 5B and the third structural element 5C. As indicated above, second joining means 62 are provided for this purpose, which are preferably equivalent from a structural viewpoint to the first joining means 61 described above with reference to the length T2 of rib 1. Therefore, the indications regarding the first means 61 must also be considered valid for the second joining means 62.

On the basis of the indications above, the first and the second joining means 61,62 permanently connect the structural elements 5A,5B and 5C of the rib 1 so that a "continuous" cavity extending substantially for the entire extension thereof is defined therein. This cavity is therefore formed by a plurality of lengths each corresponding to an inner cavity 9A,9B,9C of a relative structural element 5A,5B and 5C. In other words, the joining means 61,62 preferably make the inner cavities of the single elements communicating.

Again with reference to FIG. 1, the rib 1 is provided with vent means to allow the outflow of air during filling of the continuous cavity indicated above. For this purpose, the vent means are operatively placed in proximity of the highest portion of the rib 1 (indicated with the reference T5 in FIG. 1) with respect to a plane of reference P on which it rests. In the embodiment shown in the figures, the vent means comprise an opening 6 (see FIG. 2) produced on the tubular body C2 of the second structural element 5B. As shown, once installation of the rib 1 has been completed, the vent opening 6 is located in the highest point of the "vault" defined by the rib.

According to an embodiment preferred according to the invention, the rib 1 comprises a pair of bearing elements 90 each coupled to a relative structural element 5A,5C so as to allow a relative movement of the structural elements 5A,5B 5C of the rib 1 after pressurized injection of concrete. This last expression indicates prolonged injection of concrete beyond the time required for complete filling of the inner cavities 9A,9B,9C of the structural elements 5A,5B,5C. In other words "pressurized injection" is intended as an injection of concrete that takes place at a pressure above atmospheric pressure or with the vent means closed, for example through the use of a valve. From an operational viewpoint this latter condition allows the internal pressure of the concrete to be increased, in substance subjecting the rib 1 to pre-loading. Pressurized injection in fact causes an increase in the internal pressure of the concrete that translates into a system of forces that are transferred to the inner walls of the structural elements 5A,5B,5C inducing thereon a relative movement with respect to the bearing elements 90, the position of which remains unvaried.

The movement of the structural elements 5A,5B,5C allows an increase of the supporting and reinforcing effect of the excavation, as the system of forces is transferred from the walls of the structural elements to the excavation wall. In fact, pressurized injection of concrete can be prolonged until the rib 1 adheres to the excavation with a certain "pressure", which will be directly proportional to the internal pressure of the concrete. Prolonged injection therefore advantageously makes the rib 1 "active" in relation to the reinforcement. Differently, conventional ribs behave passively.

It is observed that subsequent solidification of the concrete advantageously maintains the state of tension reached between the rib 1 and the excavation after prolonged injection of concrete. Through this special configuration of the bearing elements 90, the rib 1 is substantially "expansible" between a first and a second configuration respectively characteristic of normal filling and of pressurized filling. From an operational viewpoint, this translates into the possibility of producing the rib 1 with greater tolerance with respect to the dimensions of the excavation. In other words, the rib 1 can have slightly smaller dimensions with respect to the excavation to the advantage of easy connection of the structural elements 5A,5B,5C or easier operational installation. Moreover, it is observed that injection of concrete, optionally fiber-reinforced, into the cavity of the structural elements 5A,5B,5C of the rib 1 increases the mechanical resistance not only to bending, but also to torsional stresses as a result of the closed section of the tubular bodies of these elements. This in fact makes the rib 1 usable in any condition.

Figure 7:
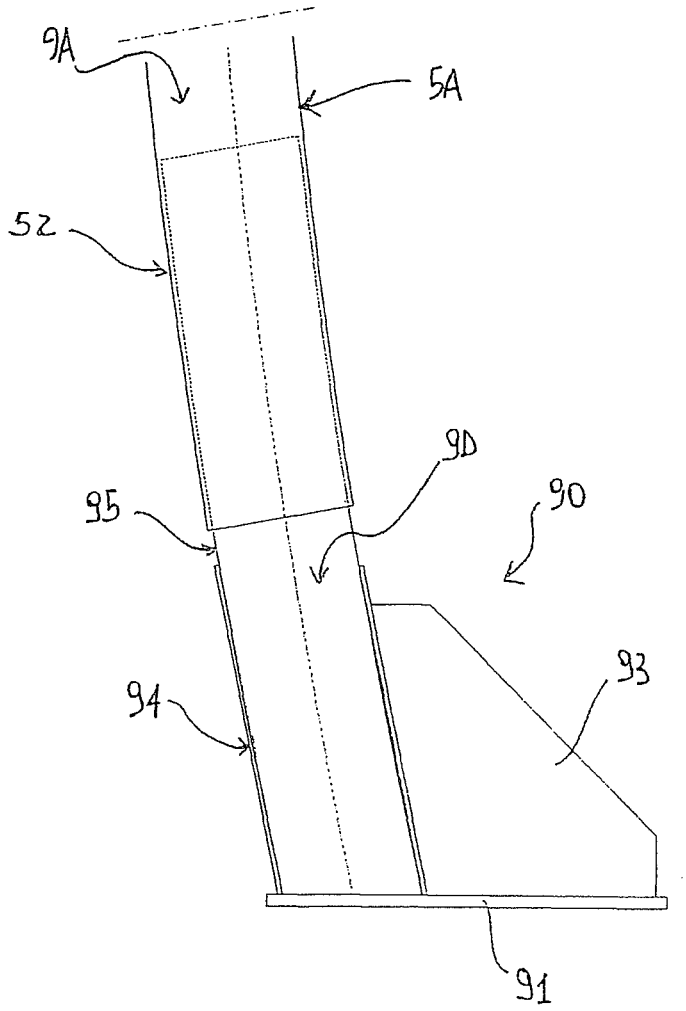
FIG. 7 is a view of a second embodiment of a bearing element of a rib according to the present invention.

FIG. 7 shows in detail a possible embodiment of the two bearing elements 90 of the rib 1 which allow a relative movement of the structural elements 5A,5B,5C. In particular, reference is made below to the bearing element 90 connected to the first structural element 5A, but the considerations below must also be considered valid for the one connected to the third structural element 5C. The bearing element in FIG. 7 comprises at least a tubular portion with circular section coupled slidingly to the first end portion 51 of the first structural element 5A. More precisely, the section of the tubular portion has a shape corresponding to that of the end portion 52 of the relative structural element 5A,5C (circular in the examples shown).

The bearing element 90 comprises a base plate 91 and stiffening plates 98 connected, preferably by welding, to an outer tubular portion 94 with circular section (similarly to the solution in FIGS. 3 to 3B). The bearing element 90 also comprises an inner tubular portion 95 with a circular section and coaxial with the outer portion 94. The inner tubular portion 95 is coupled in a telescoping manner to the second end portion 52 of the first structural element 5A (these considerations must be considered valid for connection between the third structural element 5C and the relative bearing element 40). The inner cavity 9A of the first structural element 5A is communicating with the inner cavity 9D of the inner tubular portion 95 of the bearing element 90 so as to allow filling thereof through injection of concrete. In this solution injection of concrete is performed through the filling device associated with the relative structural element (first 5A or third 5C according to the bearing element considered).

Figure 8:
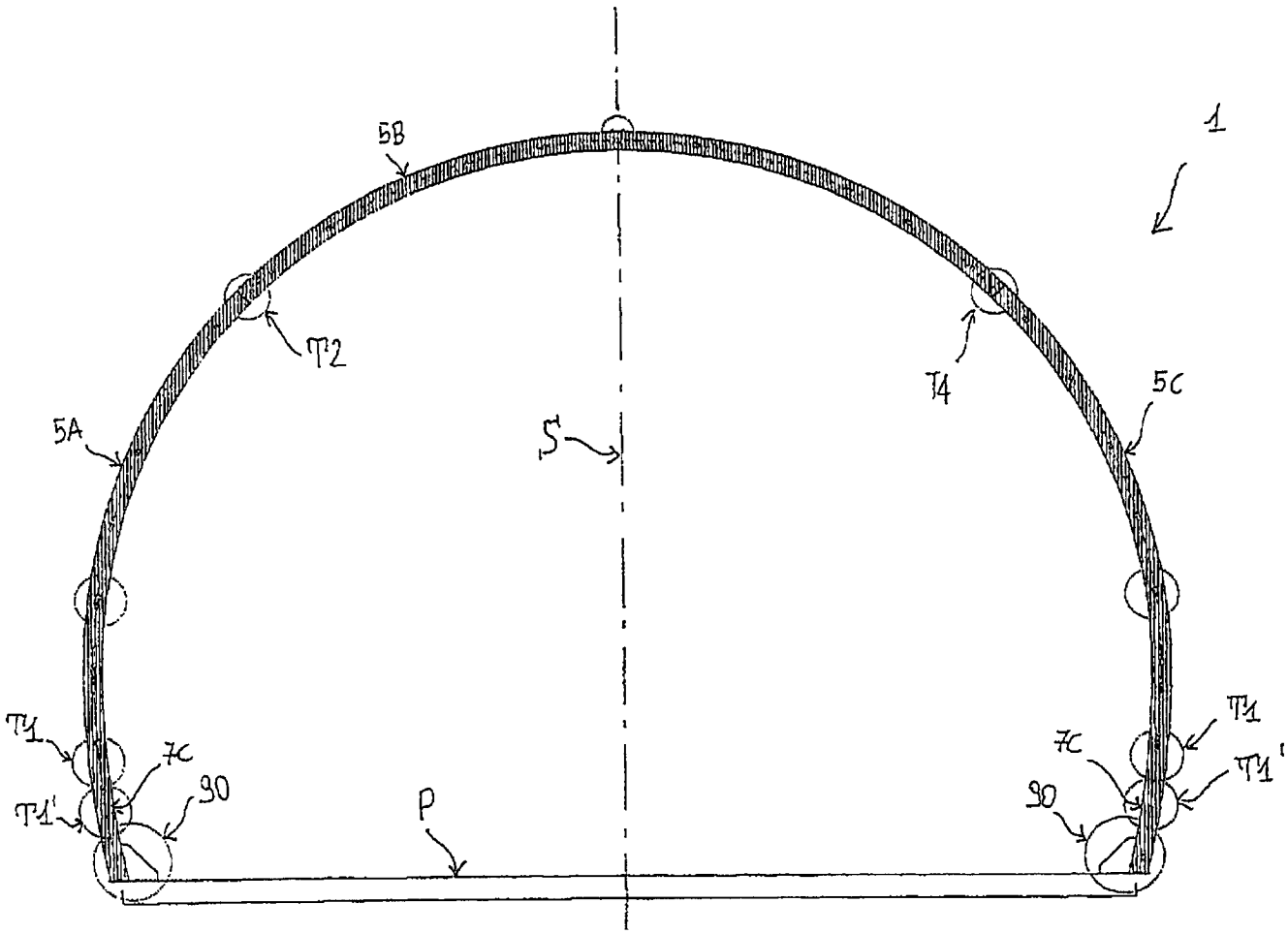
FIG. 8 is a view of a second possible embodiment of a rib according to the present invention.
Figure 9:
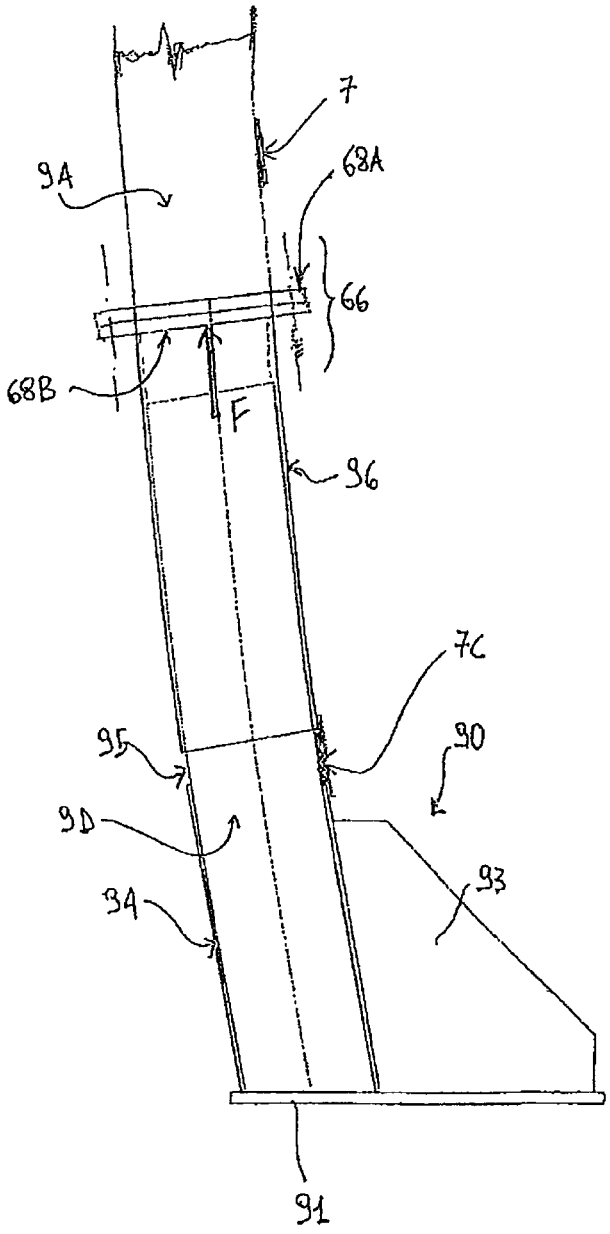
FIG. 9 is a view of a bearing element of the rib of FIG. 7.

FIG. 8 relates to a further embodiment of a rib 1 according to the present invention, differing from that of FIG. 6 due to a different configuration of the bearing elements 90, one of which is shown in FIG. 9. More precisely, with respect to the embodiment in FIG. 7, the bearing element 90 comprises an outer connecting tubular portion 96 coupled in a telescoping manner to the inner tubular portion 94. This connecting portion 96 is connected to the second end portion 52, 72 of the relative structural element (first 5A or third 5C depending on the bearing element considered) through joining and closing means 66. These latter are configured so as to maintain the inner cavity 9A,9C of the relative structural element 5A,5C separate from the inner cavity 9D defined by the inner element 94 and by the connecting portion 96. The joining and closing means 66 make the connecting portion 96 integral with the relative structural element 5A,5C of the rib 1 simultaneously defining an upper obstructing wall 68A delimiting the bottom of the cavity 9A,9C of the relative element 5A,5C and a lower obstructing wall 68B delimiting the top of the cavity 9D defined by the tubular portions 96,95 of the connection element 90.

According to this embodiment, each bearing element 90 is provided with a relative filling device 7C of the inner cavity 9D defined on a length (indicated with the reference T1') of the inner tubular portion 94. Filling of the structural elements 5A,5B,5C with concrete is instead performed through a pair of filling devices 7,77 associated with the first 5A and with the third element 5C according to the indications above. From an operational viewpoint, prolonged injection of concrete into the cavity 9D (i.e. beyond the normal filling) increases the internal pressure of the concrete determining a thrust F on the lower obstructing wall 68B defined by the joining and closing means 66. This thrust F causes lifting of the structural elements 5A,5B,5C with respect to the bearing elements 90. In this way the structural elements 5A,5B,5C adhere to the inner surface of the excavation supporting and reinforcing it through an active action. It is observed that in the embodiment of FIG. 9, the structural elements 5A,5B,5C can simply be filled, but that prolonged pressurized injection of concrete is also possible in this case according to the principles set down above in relation to the rib 1 in FIG. 7.

Figure 10:
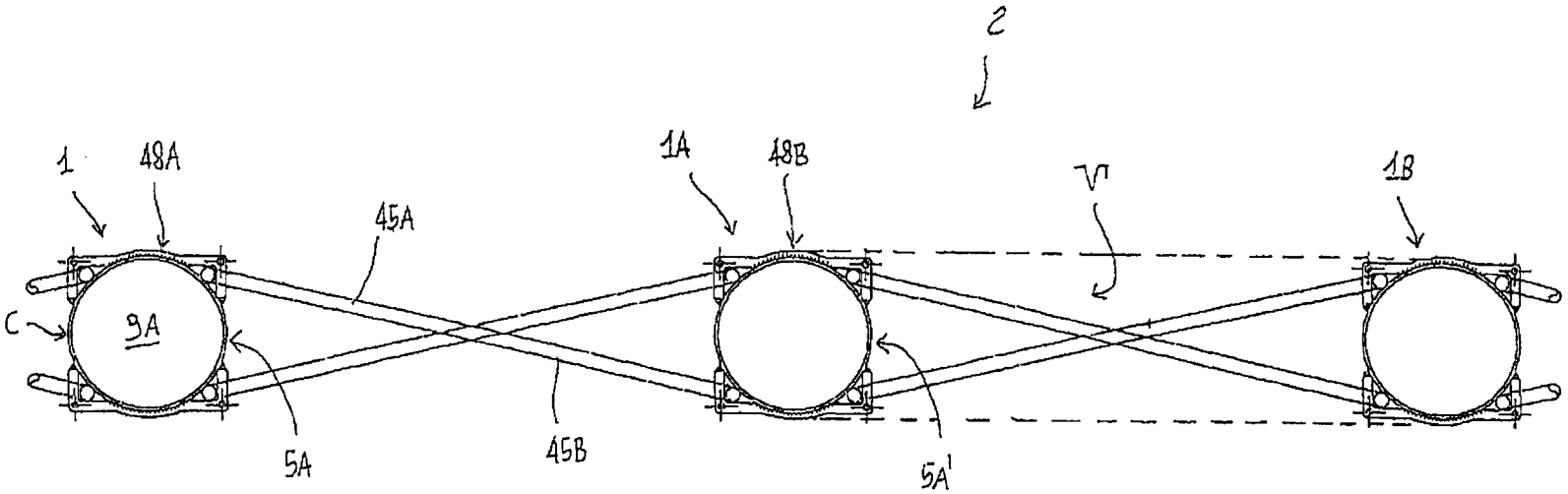
FIG. 10 is a view relative to a reinforcing structure of an excavation comprising a plurality of ribs according to the present invention.
Figure 12:
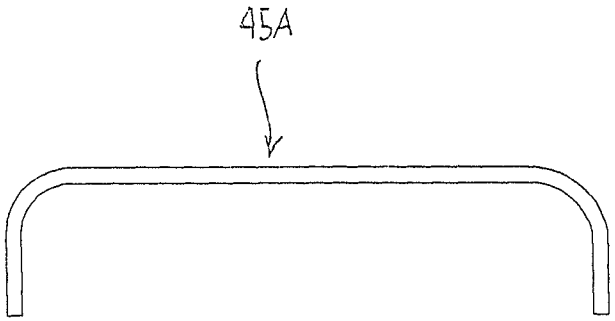
FIG. 12 is relative to a link for connection of two ribs according to the present invention.

The present invention also relates to a reinforcing structure 2 of an excavation comprising one or more ribs according to the present invention. For this purpose, FIG. 10 shows a structure comprising three ribs (indicated with the references 1,1A,1B) which are mutually connected through the use of connection links 45A,45B, an example of which is shown in FIG. 12. Any one rib is connected to a previously installed rib before said any one rib is filled with concrete using the possible methods described above.

Each connection link 45A,45B is coupled, with a first end, to a first connection member 48A associated with a first rib (indicated with the reference 1) and with a second end to a second connection member 48B associated with a second rib (indicated with the reference 1A). For each rib 1,1A,1B the connection members 48A,48B are connected, preferably by welding, at predetermined intervals along the tubular bodies C defining the structural elements 5A,5B,5C. Each connection link 45A,45B connects connection members 48A,48B belonging to adjacent ribs 1,1A, but arranged at the same height H with respect to a plane of reference which can, for example, be the plane P on which the ribs rest (see FIG. 1).

Figure 11A:
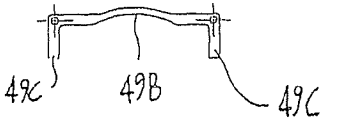
FIGS. 11,11A and 11B are relative to a connection member of a rib according to the present invention.
Figure 11B:
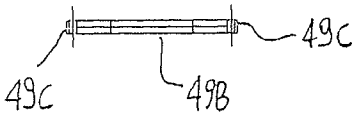
Figure 11:
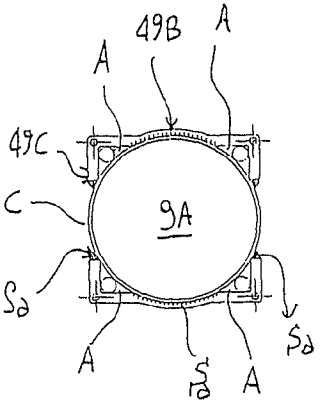

FIGS. 11,11A and 11B allow observation of a preferred embodiment of the connection members 48A,48B. In particular, FIG. 11 relates to one of the cross sections of the rib 1 (indicated in FIGS. 1,2 with the reference T3) at which one of said connection members is welded. As shown, each connection members 48A,48B comprises a pair of shaped portions 49 (shown in FIGS. 11A,11B) arranged on opposite sides with respect to the centre of the circular section of the body C of the relative structural element 5A,5B,5C. Each shaped portion 49 has a substantially U-shaped structure with the arch shaped central side 49B with curvature corresponding to that of the outer surface of the body C. The two opposite sides 49C of the shaped portion 49 extend in mutually parallel position.

The configuration of the shaped portion 49 is particularly advantageous from an operational viewpoint as it facilitates connection operations, i.e. welding of this portion to the body C. In fact, the curvature on the central side 49B allows the correct welding position to be easily maintained. For this purpose, in FIG. 11 the different weld seams are indicated with the reference Sa. It is also observed that the configuration of the shaped portions 49 in substance defines four coupling areas A each of which defined between the tubular body C and the sides 49B,49C of this portion. As can be seen in FIG. 10, this solution allows two links 45A,45B to be used to connect two adjacent ribs 1,1A or 1A,1B. This advantageously increases the resistance of the connection and increases the overall properties of mechanical resistance of the reinforcing structure 2.

Again with reference to FIG. 10, it is also observed that two links 45A,45B connect two adjacent ribs so that these links assume a mutually "crossed" position with respect to an observation plane orthogonal to the axes of the elements of the ribs, i.e. with respect to the observation point of the view in FIG. 10. This arrangement on the one hand allows an increased connection effect to be obtained and on the other does not obstruct the application of concrete between the ribs. For this purpose, in FIG. 10 the two broken lines delimit the volume V between two adjacent ribs destined to be filled with concrete (for example shotcrete).

It can be observed that the circular shape of the tubular body C of the various structural elements 5A,5B,5C allows improved distribution of the concrete between the ribs 1,1A, 1B as it can completely surround the outer surface of each rib without leaving uncovered regions as, for example, occurs in ribs with H or double T section. Moreover, the circular section of the structural elements 5A,5B,5C offers greater resistance to torsional stresses with respect those possible with open sections (H, C or double T). With the same stresses, this fact translates into the possibility of limiting the dimensions and material of the rib, i.e. the production costs.

The present invention therefore also relates to a method for supporting and reinforcing an excavation comprising at least the steps of:

installing a first rib 1 according to the present invention;

filling the inner cavities 9A,9B,9C of the structural elements 5A,5B,5C of the rib with concrete at least until complete filling thereof.

For the objects of the present invention, the expression "installing a rib" substantially indicates operatively placing the rib below the excavation to be supported and reinforced. Preferably, the method provides for the use of a rib the structural elements of which comprise tubular bodies with circular cross section. The method preferably provides for the installation of a rib 1 provided with bearing elements 90 coupled to the relative structural elements 5A,5B so as to allow a relative movement 5A,5B,5C according to the indications above. In the presence of such bearing elements for the rib, the method preferably provides for filling the inner cavities 9A,9B,9C of the structural elements with pressurized concrete so as to produce an active reinforcement of the excavation according to the methods and aims indicated above.

After installation of the first rib (i.e. filling the cavity with concrete in normal or pressurized conditions), the method preferably provides for the steps of:

installing a second rib 1A according to the present invention;

connecting the first rib 1 to the second rib 1A through at least one connection link;

filling the inner cavities of the structural elements of the second rib 1A with concrete at least until complete filling thereof.

Preferably, the method provides for connection of the second rib 1A to the first 1 through a plurality of connection links coupled at the respective ends to connection members provided on the two ribs 1,1A at a corresponding height H (see FIG. 1). In particular, the links are preferably connected to pairs of connection members positioned at corresponding heights H, on adjacent ribs, so as to be "crossed" as shown in FIG. 12.

The technical solutions adopted for the rib and for the method for supporting and reinforcing an excavation allow the set aim and objects to be fully accomplished. In particular, the use of ribs with "tubular" structural elements combined with the use of concrete allows high mechanical performances to be achieved with a limited use of material. For this purpose, the use of elements with a "closed" cross section, preferably circular, allows performances to be varied by varying the steel-to-concrete ratio (i.e. the thickness of the elements) with the same external dimensions (i.e. with the same external diameter in the case of circular cross sections). This obviously is advantageous to installation times and costs. The use of the circular cross section also advantageously allows the problem relative to the application of concrete (shotcrete) between two adjacent ribs to be solved, as the outer surface of the elements can be completely covered with concrete without empty spaces being formed.

The rib, the structure and the method for supporting and reinforcing thus conceived are susceptible to numerous modifications and variants, all falling within the scope of the inventive concept; moreover all details can be replaced by other technically equivalent details.

In practice, the materials used and the contingent dimensions and forms can be any, according to requirements and to the state of the art.

The invention claimed is:

1. A structure for supporting and reinforcing an excavation comprising a rib arrangement including a plurality of ribs, each rib being connected to an adjacent rib through one or more connection links, each rib including a structural element comprising a tubular body provided with an inner cavity adapted to be completely filled with concrete after installation of the rib, at least one of said structural elements comprising a filling arrangement operatively couplable to means for injecting concrete at a pressure greater than atmospheric pressure into the respective said inner cavity, the rib arrangement further including a vent arrangement for the outflow of air during injection of concrete into said inner cavity, each rib comprising a plurality of connection members arranged at predetermined intervals along the structural element thereof, each connection link being coupled to connection members arranged on different ribs at a corresponding height, and each connection member being configured so as to allow coupling of at least two connection links thereto.

2. The structure according to claim 1, wherein said filling arrangement comprises an opening defined in said body of said at least one structural element and in communication with said inner cavity thereof and a closing element, said closing element being movable between a closed position to close off the opening and prevent escape of concrete from said inner cavity and an open position to allow injection of concrete into said inner cavity.

3. The structure according to claim 1, wherein said tubular body of some of said structural elements has a substantially circular cross section.

4. The structure according to claim 1, wherein the structural element of each said rib is a first structural element and each said rib further includes a second structural element comprising a first terminal portion connected to a first end portion of the respective said first structural element, each said second structural element comprising a tubular body provided with an inner cavity adapted to be filled with concrete after installation of the respective said rib, said inner cavity of said first structural element of each said rib being in fluid communication with the inner cavity of said second structural element of the respective said rib.

5. The structure according to claim 4, wherein each said rib comprises a third structural element comprising a tubular body provided with an inner cavity adapted to be filled with concrete after installation of the respective said rib, each said third structural element comprising an end portion connected to a second terminal portion of the respective said second structural element, said inner cavity of said second structural element of each said rib being in fluid communication with the inner cavity of said third structural element of the respective said rib.

6. The structure according to claim 5, wherein each said rib comprises a first bearing element connected to a second end portion of said first structural element, the end portion of the third structural element being a first end portion, each said rib comprising a second bearing element connected to a second end portion of the third structural element thereof, the first and second bearing elements being mounted to the respective first and third structural elements of each said rib to allow movement of each of said first, second and third structural elements relative to the excavation after the inner cavities of the first, second and third structural elements are completely filled with concrete.

7. The structure according to claim 6, wherein each said first structural element comprises a said filling arrangement and each said third structural element comprises a filling arrangement operatively couplable to means for injecting concrete at a pressure greater than atmospheric pressure into the respective said inner cavity of said third structural element.

8. The structure according to claim 1, wherein each said rib comprises a bearing element connected to an end portion of said structural element thereof, the bearing element being mounted to the structural element to allow movement of said structural element relative to the excavation after the inner cavity of said structural element is completely filled with concrete.

9. The structure according to claim 1, wherein said vent arrangement comprises a valve.

10. The structure according to claim 1, wherein the filling arrangement is disposed so that the concrete travels upwardly through the cavity of the at least one structural element when injected into the filling arrangement, and the vent arrangement is disposed at a greater elevation than the elevation of the filling arrangement.

11. A method for supporting and reinforcing an excavation using a structure comprising a rib arrangement having the structure according to claim 1, said method comprising the steps of:

installing a first rib of said plurality of ribs;

filling the inner cavity of the structural element of said first rib with concrete at least until complete filling thereof;

installing a second rib of said plurality of ribs in a position adjacent to said first rib;

connecting said first rib to said second rib through one or more connection links; and filling the inner cavity of the structural element of said second rib with concrete at least until complete filling thereof.

12. A rib arrangement for supporting and reinforcing an excavation comprising, a plurality of ribs arranged in side-by-side relation with one another at the excavation, each said rib including a structural element comprising a tubular body provided with an inner cavity adapted to be completely filled with concrete after installation of the rib, said structural element of at least one of said ribs mounting thereon a connection member, said connection member including two mounting locations thereon, each mounting location being configured for coupling to a separate connection link, at least one of said structural elements comprising a filling arrangement operatively couplable to means for injecting concrete at a pressure greater than atmospheric pressure into said inner cavity, said rib arrangement further including a vent arrangement for the outflow of air during injection of concrete into said inner cavity.

13. The rib arrangement according to claim 12, further including a plurality of connection links, wherein said one rib is a first rib and said structural element of said one rib mounts thereon two said connection members on opposite sides thereof and said structural element of another of said ribs mounts thereon two said connection members on opposite sides thereof, said another of said ribs being a second rib disposed adjacent said first rib, first and second ones of said plurality of connection links extending transversely between said first and second ribs, said first connection link having a first end connected to a first of said two connection members of said first rib at one of the mounting locations thereof and a second end connected to a first of said two connection members of said second rib at one of the mounting locations thereof, and said second connection link having a first end connected to a second of said two connection members of said first rib at one of the mounting locations thereof and a second end connected to a second of said two connection members of said second rib at one of the mounting locations thereof.

14. A method for supporting and reinforcing an excavation comprising:

providing a rib arrangement comprising first and second ribs, each of the first and second ribs including a structural element comprising a tubular body provided with an inner cavity adapted to be completely filled with concrete after installation of the rib, at least one of the structural elements comprising a filling arrangement operatively couplable to means for injecting concrete into the respective said inner cavity, and the rib arrangement including a vent arrangement for the outflow of air during injection of concrete into the inner cavity;

installing the first and second ribs at the excavation in side-by-side relation to one another;

providing a connection member on the structural element of at least one of the first and second ribs, the connection member being configured to allow coupling of two connection links thereto;

coupling means for injecting concrete to the filling arrangement provided on the at least one structural element;

injecting concrete at a pressure greater than atmospheric pressure into the filling arrangement and into the inner cavity of the tubular body of the at least one structural element with the concrete injecting means;

filling the inner cavity of the tubular body of the at least one structural element with concrete with the concrete injecting means; and during said step of filling, venting air located within the inner cavity of the tubular body of the at least one structural element to the atmosphere through the vent arrangement.

* * * * *